US005901864A

United States Patent [19]

Morrow

[11] Patent Number: 5,901,864

[45] Date of Patent: May 11, 1999

[54] MOVABLE CRANE APPARATUS

[75] Inventor: William D. Morrow, Houston, Tex.

[73] Assignee: SeaTrax, Inc., Houston, Tex.

[21] Appl. No.: 08/842,235

[22] Filed: Apr. 23, 1997

Related U.S. Application Data

[63] Continuation-in-part of application No. 08/720,895, Oct. 3, 1996, abandoned

[60] Provisional application No. 60/029,181, Oct. 6, 1995.

[51] Int. Cl.[6] ..... B66C 17/06

[52] U.S. Cl. ..... 212/179; 212/253; 212/309

[58] Field of Search ..... 212/253, 179, 212/180, 181, 309, 310, 311; 114/90, 93

[56] References Cited

U.S. PATENT DOCUMENTS

| | | |
|---|---|---|
| 212,307 | 6/1879 | Sherwood . |
| 226,996 | 4/1880 | Greenleaf . |
| 353,083 | 11/1886 | Reid . |
| 643,360 | 2/1900 | Lord . |
| 1,018,529 | 2/1912 | Swensson . |
| 2,699,875 | 1/1955 | Stratton . |
| 3,160,284 | 12/1964 | Moore . |
| 3,268,092 | 8/1966 | Hainer et al. ..... 212/179 |
| 4,061,230 | 12/1977 | Goss et al. . |
| 4,354,606 | 10/1982 | Morrow et al. . |
| 4,513,869 | 4/1985 | Goudy . |
| 4,655,154 | 4/1987 | Leonard . |
| 5,310,067 | 5/1994 | Morrow . |

FOREIGN PATENT DOCUMENTS

| | | |
|---|---|---|
| 26 37 682 | 2/1978 | Germany . |
| 307967 | 6/1971 | U.S.S.R. . |
| 10730 | 5/1894 | United Kingdom . |
| 1044909 | 10/1966 | United Kingdom . |
| 1121480 | 7/1968 | United Kingdom . |
| 1137565 | 12/1968 | United Kingdom . |
| 1179174 | 1/1970 | United Kingdom . |
| 1572545 | 7/1980 | United Kingdom . |
| 2177374 A | 1/1987 | United Kingdom . |

*Primary Examiner*—Thomas J. Brahan
*Attorney, Agent, or Firm*—Keeling Law Firm

[57] ABSTRACT

A movable pedestal or kingpost type luffing crane that includes an upperworks, having a crane boom, rotatably mounted on a crane support. The crane support extends below the upperworks. The movable crane is constructed to be selectively maintained in or removed from a receiving socket. Movement prevention means prevents the radial and vertical movement of the crane support in the receiving socket. Anti-rotation means prevents the rotation of the crane support in the receiving socket. A centering means is also provided which facilitates the centering of the crane support means within the receiving socket. Providing a plurality of receiving sockets located at predetermined locations provides a system wherein the movable crane may be moved from socket to socket and from location to location.

19 Claims, 4 Drawing Sheets

MOVABLE CRANE APPARATUS

This application is a continuation-in-part and claims the benefit of U.S. patent application Ser. No. 08/720,895 filed by Morrow on Oct. 3, 1996, now abandoned, which itself claims the benefit of U.S. Provisional Patent Application Number 60/029,181 filed by Morrow on Oct. 6, 1995.

BACKGROUND OF THE INVENTION

1. Field of Invention

This invention relates to a movable crane. More specifically, it is directed to a pedestal or kingpost type luffing crane having a support that removably mates with a stationary receiving socket and, thereby, permits the movement of the crane from one receiving socket to another.

Presently, a number of applications need a high capacity crane that may be moved from location to location. For example, in construction that requires the use of very large capacity cranes, the cranes are transported to and temporarily mounted at the worksite. Typical of such cranes are platform ringer cranes. The platform ringer cranes include a platform rotatably mounted on a large diameter ring that has a bearing therein. The platform supports the upperworks of the crane that consists of a crane boom, the power and control devices, and the counterweights. The large diameter ring typically mounts on an above ground foundation and, thus, is gravity supported. Therefore, the platform ringer crane must include sufficient counterweight to counterbalance any weight supported at the end of the boom such that the center of gravity remains within the ring. As a result, the platform ringer cranes are extremely large and require dozens of trucks to transport.

Often, after the platform ringer crane has performed its function, the foundation remains in place for future work requiring the crane. As mentioned, the cranes, as well as the associated foundations, are extremely large. Thus, the foundation occupies substantial space making that space unusable. Therefore, providing a high capacity crane that is easier to move and permits the use of the space previously occupied by the crane eliminates these problems.

A second example of an application that needs a removable crane is in Naval transport ships. To increase its preparedness, the Navy instituted a program of fitting civilian ships with cranes. In times of war, the ships could transport goods for the war effort and load and unload the goods at any place designated by the Navy. Fitting the substantial number of ships required to supply a war effort is extremely costly due to the cost of the cranes as well as the amount of supplies required for an effective campaign. In addition, the ships, with the cranes affixed thereto, travel the world in times of peace subjecting the cranes to the harsh open sea environment. Consequently, the crane supplies of the Navy become worn and fall into disrepair because they are stored in this harsh environment.

However, the expense of providing and maintaining the cranes could be reduced by providing movable cranes. The pertinent ships could be fitted to receive the movable cranes; and the cranes could be stored in warehouses until needed. Then in times of need, the cranes could be quickly affixed to the ships for use.

A third example of an application needing a movable crane is in a merchant ship application. Many merchant ships include large capacity cranes thereon to provide for loading and unloading in ports that are not equipped with cranes. However, like in the Navy ships described above, these cranes are not needed at all times and are subjected to harsh environments. Thus, a fleet of merchant ships could share a supply of movable cranes. Additionally, the movable cranes could be stored protecting them from the elements when not needed.

U.S. Pat. No. 5,310,067 that issued to applicant herein, describes the development of kingpost cranes. As described, cranes with vertically separated bearing assemblies, such as kingpost cranes, are considered an alternative to mobile cranes. The advantages and need for the higher load capacity, safety, and stability of kingpost cranes is also described in the '067 patent. Likewise, U.S. Pat. No. 4,354,606 shows a pedestal crane. Like the kingpost in a kingpost crane, the pedestal of a pedestal crane mounts in a large fixed foundation and support such as the ground, the deck of a ship, or the deck of a loading dock. Thus, the kingpost and pedestal cranes are embedded in the foundation and not transportable.

Frequently, kingpost and pedestal cranes operate in maritime shipping, offshore, and other environments where space utilization efficiency is often crucial. The cranes require substantial space and are limited in both maximum and minimum operating distance from the kingpost or pedestal. A mobile kingpost or pedestal crane would not only provide the advantages of an embedded crane; but the kingpost or pedestal crane's mobility would additionally provide the advantage of increasing the operating distance of the embedded crane and would make available the space generally occupied by the embedded crane. Thereby, a mobile embedded crane would increase the space utilization efficiency.

Typically, due to the limited operating distance of an embedded crane, a number of cranes are often required to operatively service a given area. However, because the embedded cranes are relatively expensive, providing sufficient crane service area is often costly. Thus, a mobile embedded crane would reduce the number of embedded cranes required for a given area and, thereby, reduce the cost of providing cranes for a specified area.

2. Related Art

Although mobile cranes are commonly known to the prior art, the prior art does not disclose a luffing crane, of the kingpost or pedestal type, which is attachable to a socket in the ground, may be readily moved from one socket location to other socket locations without the need to disassemble the crane or its components, and retains the capacity and stability to support a relatively large load. Illustrative of prior art cranes are U.K. Patent Number 10,730 that issued to Purdy in May, 1894, U.K. Patent Number 2,177,374A that issued to Fluemer in January, 1987, U.S. Pat. No. 2,699,875 that issued to Stratton in January, 1955, U.S. Pat. No. 3,160,284 that issued to Moore in December, 1964, U.S. Pat. No. 4,354,606 that issued to Morrow et al. in December, 1977, U.S. Pat. No. 4,061,230 that issued to Goss et al. in December, 1977, and U.S. Pat. No. 5,310,067 that issued to Morrow in May, 1994.

Though the above mentioned cranes may be helpful for their intended purpose, they can be improved to provide mobility while maintaining the advantages of an embedded crane and, thereby, provide greater space utilization and lower cost.

SUMMARY OF THE INVENTION

Accordingly, the objectives of this invention are to provide, inter alia, a Movable Crane Apparatus, System, and Method that:

provides the advantages of an embedded luffing crane of the pedestal/kingpost type;

is movable;

increases the space utilization efficiency of the subject area;

lowers the costs associated with providing cranes for a given area;

facilitates the use of the crane on a number of different ships as well as in a number of different locations;

facilitates storage of the crane when not in use;

provides lower cost and more efficient application of a high capacity crane;

may be removed to permit utilization of the space generally occupied by the crane; and increases the area serviceable by the crane.

Other objects of the invention will become apparent from time to time throughout the specification and claims as hereinafter related.

To achieve such improvements, my invention is a movable crane that includes an upperworks, having a crane boom, rotatably mounted on a crane support means. The crane support means extends below the upperworks. The movable crane is constructed for selective maintenance in or removal from a receiving socket. Providing a plurality of receiving sockets located at predetermined locations provides a system wherein the movable crane may be moved from socket to socket and from location to location. A centering means is also provided which facilitates the centering of the crane support within the receiving socket.

BRIEF DESCRIPTION OF THE DRAWING

The manner in which these objectives and other desirable characteristics can be obtained is explained in the following description and attached drawings in which.

DETAILED DESCRIPTION OF THE INVENTION

Figure 1:
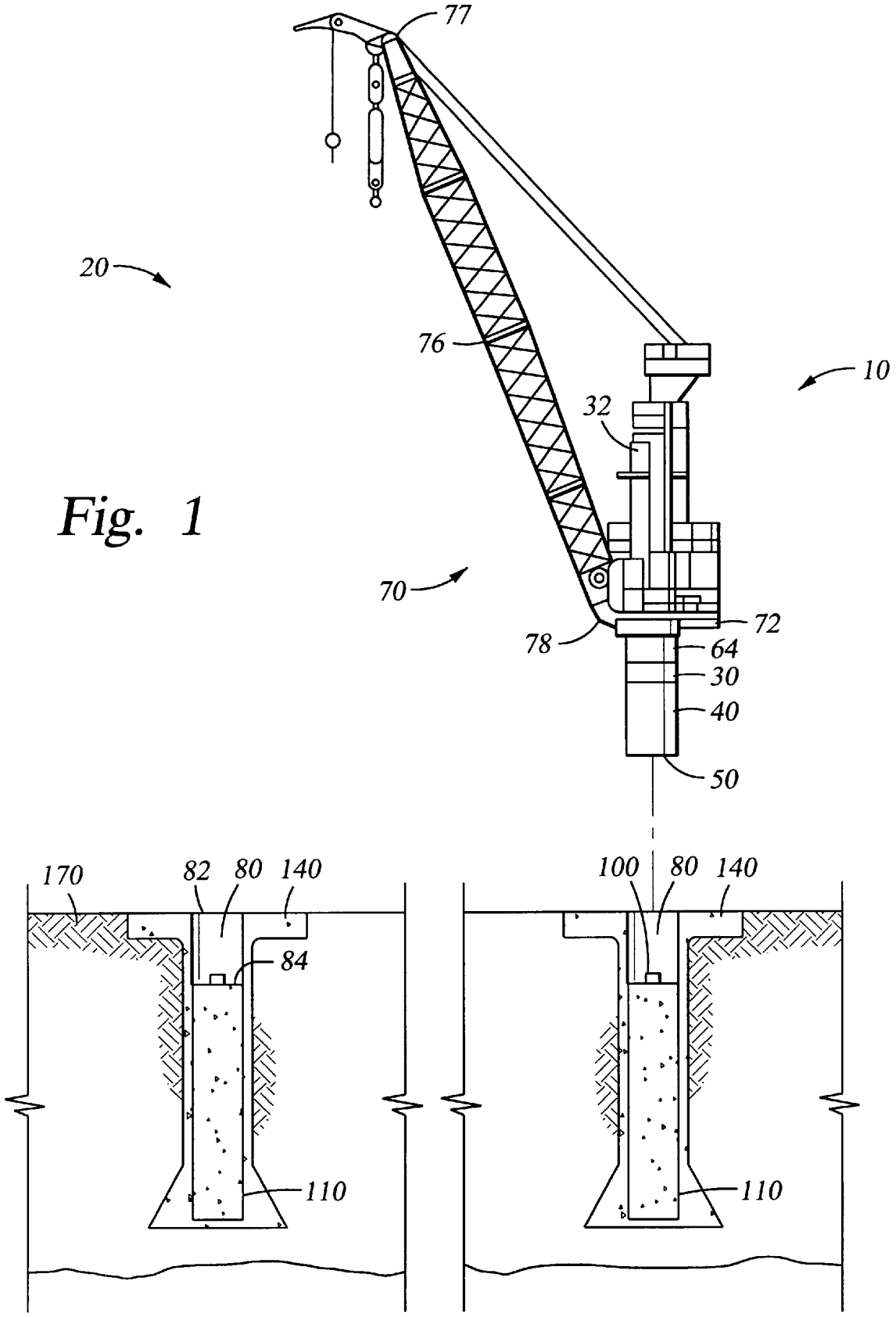
FIG. 1 is partial cross sectional side elevational view of the movable crane apparatus and system.
Figure 2:
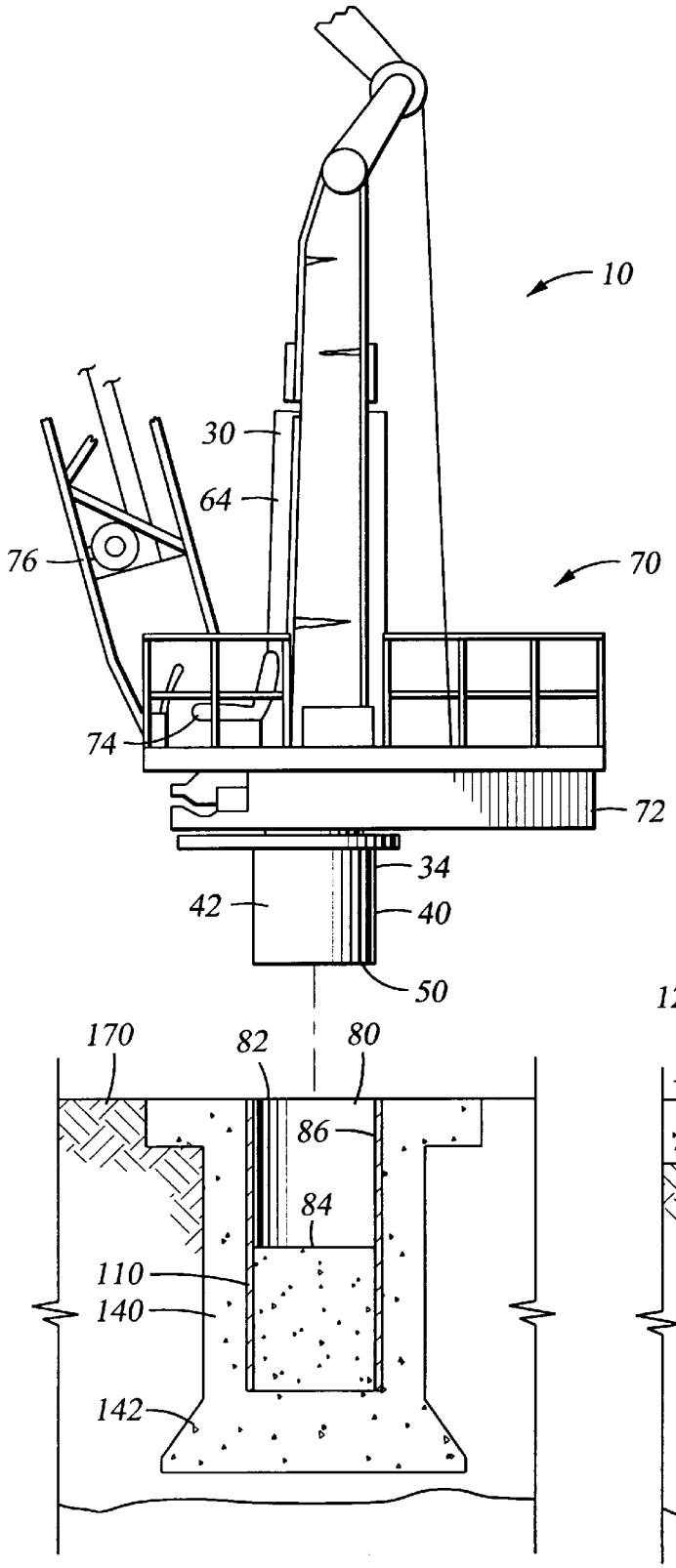
FIG. 2 is a partial side elevational view of the movable crane and a cross sectional view of the receiving socket.

The preferred embodiment of my invention is illustrated in FIGS. 1 through 9; the movable crane is depicted as 10; and the movable crane system is depicted as 20.

Generally, the movable crane 10 includes an upperworks 70 having a crane boom 76. The upperworks 70 is rotatably mounted on a crane support means 30 that extends vertically and projects below the upperworks 70. The crane support means 30 construction facilitates selective maintenance in or removal from a receiving socket 80.

In a kingpost-type movable crane 10, the crane support means 30 is a kingpost 32. Likewise, in a pedestal-type movable crane 10, the crane support means 30 is a pedestal 34.

Typically, the upperworks 70 includes a platform 72 rotatably disposed about the crane support means 30. One end 78 of the crane boom 76 is rotatably affixed to the platform 72 to permit raising and lowering of the distal end 77 of the crane boom 76. Preferably, the platform 72 provides adequate space for the heavy equipment necessary for operation of the movable crane 10. Representative of such heavy equipment is an engine for rotational motion of the movable crane 10, a hydraulic pump for hydraulic controls, and a generator for electrical controls. Additionally, the platform may provide sufficient room for an operator control station 74. The crane support means 30 has an extension 40 and a mounting area 64. The extension 40 extends below the upperworks and is constructed to mate with the receiving socket 80. Above the extension 40, the mounting area is constructed for attachment to the upperworks 70.

The receiving socket 80 includes a socket top end 82, a socket bottom end 84, a socket inner wall 86, and a substantially vertical, centrally located axis. On a moving base such as a listing ship, vertical refers to the direction perpendicular to the surface of the base or to vertical when the object is not moving. A movement prevention means 120 prevents radial and vertical movement of the crane support means 30 relative to the receiving socket 80 when a crane support means 30 is positioned therein.

The movement prevention means 120 facilitates support of the considerable torque forces created by the lifting of substantial weights at the distal end 77 of the crane boom 76 from an axially offset position. Consequently, the movement prevention means 120 must have sufficient construction to withstand the associated forces.

In the preferred embodiment, the movement prevention means 120 simply comprises the extension outer wall 42 and the socket inner wall 86 constructed for cooperative abutment and mating. When extension 40 is inserted within receiving socket 80, the extension outer wall 42 mates with and abuts the socket inner wall 86. In this way, the socket inner wall 86 provides radial and vertical support for the extension outer wall 42 and prevents radial and vertical movement of the extension 40 relative to the receiving socket 80.

Either the extension outer wall 42 or the socket inner wall 86 may include extended portions, detents, protrusions, or the like (not shown) to enhance the mating of the extension 40 to the receiving socket 80.

Movement prevention means 120 may further include a socket detent 100 and an extension detent receiver 54 which serve to prevent the radial movement of the extension 40 relative to the receiving socket 80. The socket detent 100 extends axially upward from the socket bottom end 84. The extension detent receiver 54 is a cavity that extends axially upward into the extension bottom 52. The extension detent receiver 54 mates with socket detent 100 when the crane support means 30 is positioned in the matching receiving socket 80. Herein, matching means that the related parts have a similar shape and size such that the parts fit together and cooperatively perform the specified function. For example, when the socket detent 100 is positioned in the matching extension detent receiver 54, the distance between the socket detent 100 and the extension detent receiver 54 is substantially constant. Further, the socket detent 100 abuts the extension detent receiver 54 substantially about its entire surface. Although the socket detent 100 is slightly smaller than the extension detent receiver 54 to facilitate placement therein, the difference in their size is relatively small and preferably adequate only for this purpose. This tight fit of matching parts reduces wear of the parts caused by their relative movement with significant forces applied thereto.

When cooperatively mating, the extension detent receiver 54 and the socket detent 100 prevent the radial movement of the extension bottom 52 relative to the socket bottom end 84. To prevent slippage of the extension bottom 52 relative to the socket bottom end 84, the detent wall 102 proximal the detent base 104 and the receiver wall 56 proximal the receiver lower end 62 are substantially perpendicular to the radial forces applied thereto. Because these radial forces are substantially perpendicular to the axis of the receiving socket 80, the detent wall 102 proximal the detent base 104 and the receiver wall 56 proximal the receiver lower end 62 are substantially parallel to the axis of the receiving socket 80.

Figure 3:
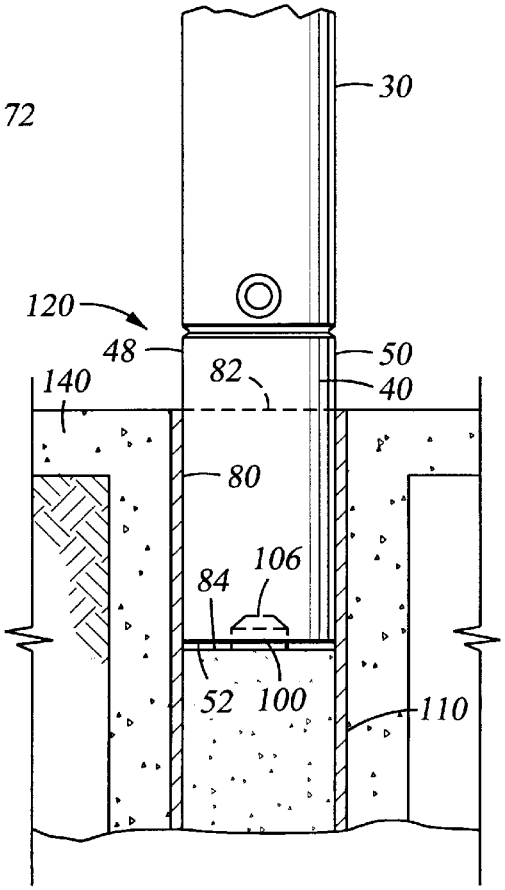
FIG. 3 is a partial side elevational view of the movable crane in the receiving socket.
Figure 4:
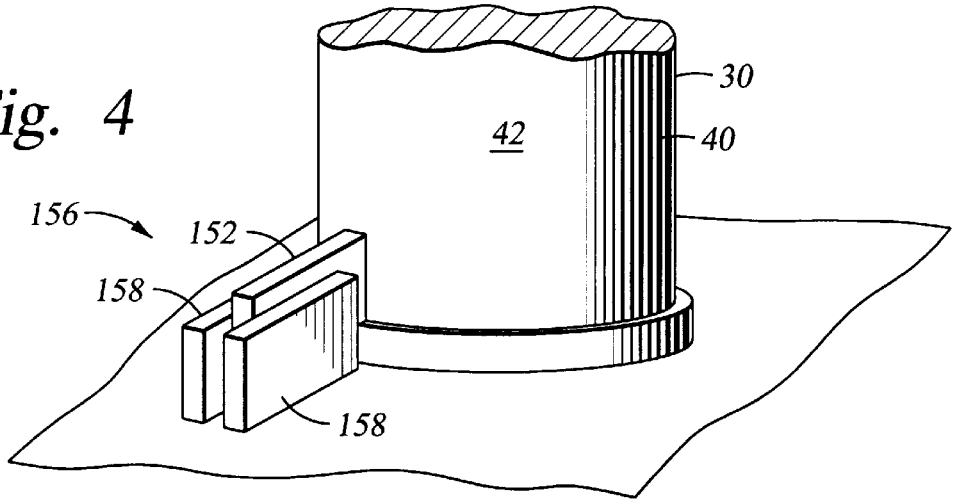
FIG. 4 is a partial isometric view of the crane support in the receiving socket.
Figure 5:
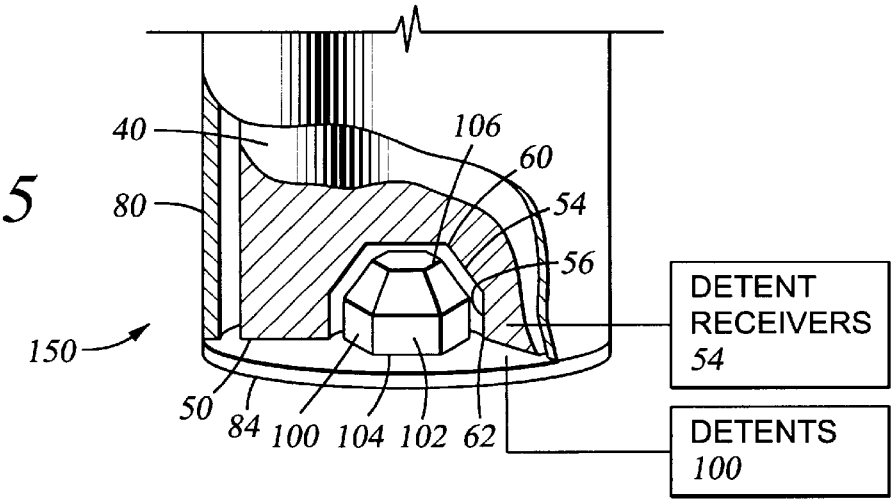
FIG. 5 is a partial isometric cross sectional view of the crane support in the receiving socket.
Figure 6:
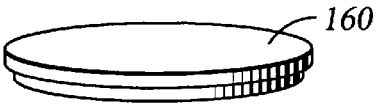
FIG. 6 is an isometric view of the receiving socket cover.
Figure 7:
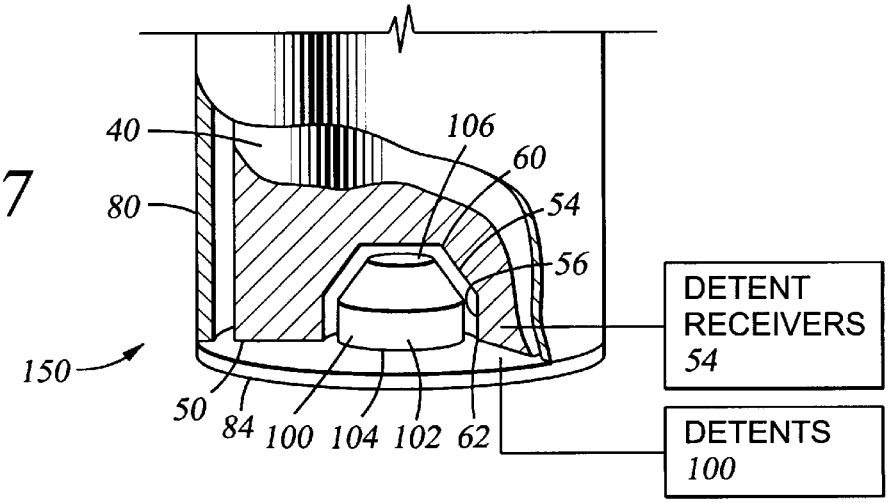
FIG. 7 is a partial isometric cross sectional view of the crane support in the receiving socket.
Figure 8:
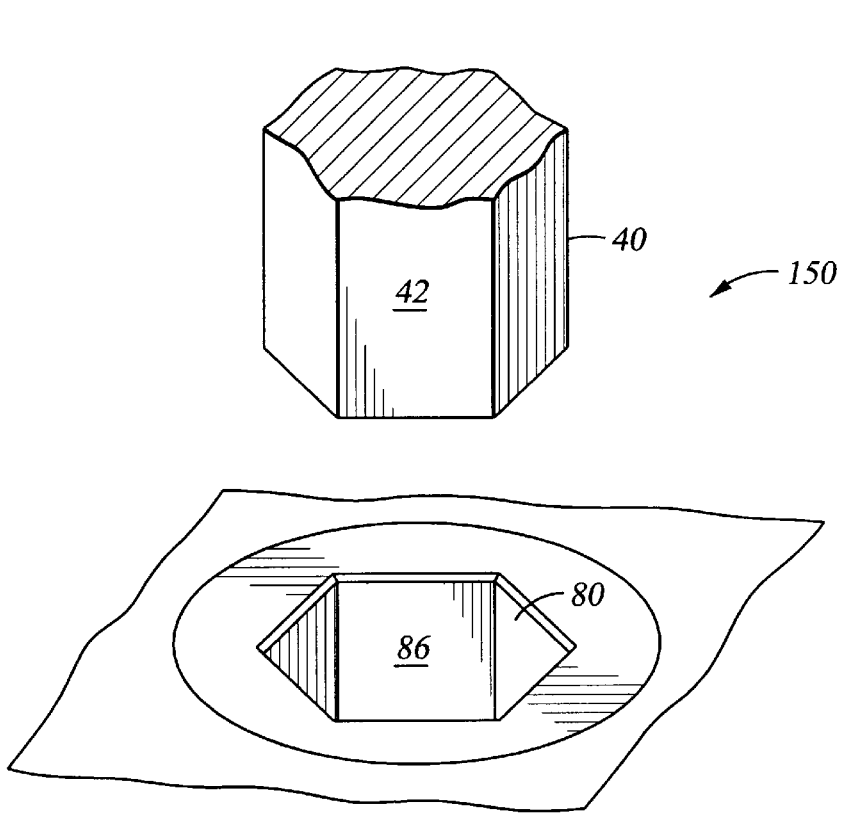
FIG. 8 is a partial isometric cross sectional view of the crane support removed from in the receiving socket.

As shown in FIG. 3, the socket detent 100 has a cross sectional area that decreases from the detent base 104 to the detent apogee 106. Although the detent may be fully tapered, as shown in the figures, the taper may occupy only an upper portion of the detent. In this way, the socket detent 100 facilitates receipt of the extension detent receiver 54 and, thereby, centering of the crane support means 30 in the receiving socket 80. As the crane support means 30 is lowered into the receiving socket 80, the receiver lower end 62 encounters the detent apogee 106. Because the detent apogee 106 is smaller than the receiver lower end 62 and, therefore, the fit between the detent apogee 106 and the receiver lower end 62 is greater, the initial placement of the socket detent 100 into the extension detent receiver 54 is less burdensome. The receiver wall 56 and the detent wall 102 are relatively smooth and provide a gradual change in the cross sectional area (1) from the detent apogee to the detent base and (2) from the receiver lower end 62 to the receiver upper end 60. Although only one socket detent 100 and matching extension detent receiver 54 is shown in the figures, the movement prevention means 120 may contain a plurality of socket detents 100 and matching extension detent receivers 54.

Figure 9:
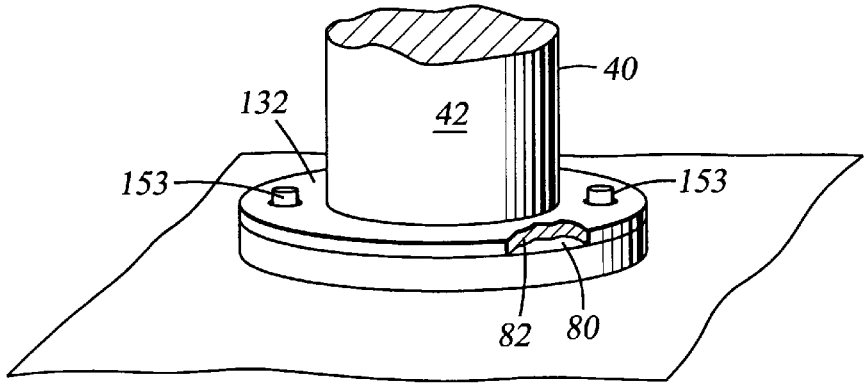
FIG. 9 is a partial isometric cross sectional view of the crane support in the receiving socket.

Additional support at the socket top end 82 or within the receiving socket 80 enhances support of the vertical and radial loads and increases the life of the movable crane 10 support components. For example, as shown in FIG. 9, a support flange 132 attached to the extension top end 50 constructed to mate with and abut the socket top end 82 may provide further radial and vertical support to the movable crane 10 and may further prevent the radial and vertical movement of the extension 40 relative to the receiving socket 80.

The movable crane 10 also includes an anti-rotation means 150 for preventing the relative rotation of the extension 40 to the receiving socket 80 when the extension 40 is positioned therein. In one embodiment, the anti-rotation means 150 is the socket detent 100 and the extension detent receiver 54 as described above. To prevent the relative rotation, the socket detent 100 and the extension detent receiver 54 are constructed and positioned to prevent the relative rotation of the crane support means 30 to the receiving socket 80. One such construction includes utilizing a noncircular socket detent 100 and a matching extension detent receiver 54. A second example of a suitable construction is the use of a plurality of socket detents 100 and matching extension detent receivers 54.

Another embodiment of the anti-rotation means 150 is a receiving socket 80 having a noncircular cross sectional shape. The extension 40 has a cross sectional shape that is similar in shape and size to the receiving socket 80 cross sectional shape. With a substantially similar, noncircular construction having a relatively tight fit, the extension 40 cannot rotate within the receiving socket 80.

A third embodiment for the anti-rotation means 150 utilizes a plate 152 attached to the extension 40 and prevented from moving by a stationary plate receiver 156. The plate 152 may be fixedly, integrally, or removably attached to extension 40. The stationary plate receiver 156 is constructed to receive the plate 152 and prevent motion of the plate 152 in a direction tangent to the extension outer wall 42. The stationary plate receiver 156 comprises a pair of proximal, substantially parallel, fixed receiver plates 158. With the extension 40 in position, the plate 152 extends between the receiver plates 158 which in turn prevents movement of the plate 152.

A fourth embodiment of the anti-rotation means 150 may be used when support flange 132 is included to provide additional radial and vertical support to the movement prevention means 120 (as shown in FIG. 9). As previously disclosed, support flange 132 is attached to extension 40. The fourth embodiment comprises at least one pin 153 which fits through matching holes (not shown) on support flange 132 and falls into matching slots (not shown) in socket top end 82. Slots (not shown) of socket top end 82 extend only partially through socket top end 82. When positioned completely through holes and slots (not shown), pins 153 are long enough that a substantial portion extends out from support flange 132. In this way, pins 153 may be easily removed.

A foundation support 140 provides support and anchor for the receiving socket 80. Preferably, the foundation support 140 encompasses the receiving socket 80 and extends into the ground 170, or other base, substantially below the receiving socket 80. The foundation support 140 adheres to standard foundation principles and its actual size varies depending upon the crane construction as well as the ground, or other base support, conditions. Preferably, the receiving socket 80 includes at least one socket anchor extension 110 fixedly attached thereto or integral therewith. The socket anchor extensions 110 extend from the receiving socket 80 into the foundation support 140 and provide an anchor for the receiving socket 80. An enlarged portion 142 of the foundation support 140 positioned below the receiving socket 80 provides enhanced anchoring for the movable crane 10.

To construct the receiving socket 80, one method is simply to provide a hole in the ground, or other base support. Placed substantially vertically within the hole, a pipe, or other suitable elongated receiving structure, provides the actual receiving socket 80. Next, poured into the hole about the pipe, a suitable foundation material, such as concrete, provides the foundation support 140. Typically, the pipe is longer than the extension 40. Thus, the pipe cavity is also filled with the foundation material to an appropriate level such that the extension bottom 52 just reaches the foundation material when placed in the receiving socket 80. In this way, the foundation material defines the socket bottom end 84. Also, the portion of the pipe that extends into the foundation material comprises the socket anchor 110.

A socket cover 160 constructed to mate with the socket top end 82 and having a similar cross sectional size and shape thereto, facilitates closing of the socket top end 82 when the crane support means 30 is removed from the receiving socket 80. Preferably, the socket cover 160 is substantially rigid and constructed to support significant weight thereon. Additionally, the socket cover 160 preferably includes a lip or other construction the prevents the socket cover 160 from inadvertently falling into the receiving socket 80. Therefore, the area generally occupied by the crane 10 may be utilized for other purposes such as storage. Further, the socket cover 160 prevents accidents which may result from an open receiving socket 80. Similarly, the socket cover 160 prevents foreign objects from entering an open, unused receiving socket 80.

A movable crane system 20 is made up of the above described movable crane 10 and a plurality of receiving sockets 80 as described above. The crane support means 30 is removably positionable within any of the plurality of receiving sockets 80. Thus, the movable crane 10 may be selectively maintained in or removed from any of the plurality of receiving sockets 80. Generally, a truck or other vehicle provides transport of the movable crane 10. Although the transport vehicle could be incorporated into the movable crane 10, this design is not preferred. Socket covers 160 may cover the unused receiving sockets 80.

A preferred embodiment of the invention discloses an upperworks 70 and support means 30 that can be set into the socket 80 as an integral unit. In such an embodiment, it will be further noted that the support means 30 is simply plugged into the socket 80; that is, the support means 30 is readily placed within the socket 80 or removed from the socket 80 without the disassembly of the crane 10 or its component parts. It is also noted with regard to the embodiment of the anti-rotation means 150 involving the pin 152 and complementary stationary pin receiver 156 that insertion or removal of the pin 152, a relatively simple step, might be required to plug the crane 10 into the socket 80 or remove the crane 10 from the socket 80.

A method of reducing the number of cranes required for a specified area, for increasing the service area of a movable crane, for increasing the space utilization efficiency and for increasing the use efficiency of the movable cranes 10 is to functionally apply the above described apparatus 10 and system 20.

I claim:

1. A movable kingpost crane comprising:

an upperworks, including a crane boom;

said upperworks including a platform;

said crane boom rotatably affixed at an end to said platform;

said crane boom including an end distal from said platform;

said crane boom distal end capable of being raised and lowered;

crane support means for supporting said upperworks;

said upperworks rotatable in relation to said crane support means;

said crane support means constructed to be selectively maintained and affixed in a receiving socket;

said crane support means including an extension constructed to mate with said receiving socket;

said crane support means removable from said socket;

a socket detent extending axially upwards from a socket bottom end;

said extension including an extension bottom;

said extension bottom including a detent receiver; and said socket detent and said detent receiver constructed and positioned for cooperative mating when said crane support means is positioned in said socket.

2. A movable crane as claimed in claim 1 wherein:

said socket detent having a detent base proximal said socket bottom end and a detent apogee distal said socket bottom end;

said socket detent at least partially tapered adjacent said detent apogee;

whereby said cooperative mating and said at least partial taper facilitate centering of said crane support means in said socket.

3. A movable crane as in claim 2 wherein said crane support means having a mounting area above said extension constructed for attachment to said upperworks.

4. A movable crane as claimed in claim 2 further comprising:

said receiving socket including a socket top end, a socket inner wall, and a substantially vertically extending axis; and movement prevention means for preventing radial and vertical movement of said extension relative to said receiving socket.

5. A movable crane as claimed in claim 4 wherein said movement prevention means comprises:

an extension outer wall of said extension;

said extension outer wall and said socket inner wall constructed for cooperative abutment and mating;

said extension bottom and said socket bottom end constructed for cooperative abutment and mating;

whereby said socket inner wall and said socket bottom end provide radial and vertical support for said extension outer wall and said extension bottom respectively and prevent radial and vertical movement of said extension relative to said receiving socket when said extension is positioned in said receiving socket.

6. A movable crane as claimed in claim 5 wherein said movement prevention means further comprises:

said socket detent;

said detent receiver; and said cooperative mating of said socket detent and said detent receiver preventing radial movement of said extension bottom relative to said socket bottom end when said extension is positioned in said receiving socket.

7. A movable crane as claimed in claim 6 wherein said movement prevention means further comprises:

an extension top end of said extension;

a support flange fixedly attached to said extension top end; and said support flange constructed to mate with and abut said socket top end and support radial and vertical loads associated with said movable crane.

8. A movable crane as claimed in claim 2 further comprising anti-rotation means preventing relative rotation of said crane support means in relation to said receiving socket.

9. A movable crane as claimed in claim 8, wherein said anti-rotation means comprises:

said socket detent and said detent receiver; and whereby said socket detent and said detent receiver are constructed and positioned to prevent rotational movement of said extension relative to said receiving socket when said extension is positioned in said receiving socket.

10. A movable crane as claimed in claim 9 wherein said construction and position of said socket detent and said detent receiver comprises a noncircular socket detent and a matching detent receiver.

11. A movable crane as claimed in claim 9 wherein said construction and position of said socket detent and said detent receiver comprises a plurality of said socket detents and matching detent receivers.

12. A movable crane as claimed in claim 8, wherein said anti-rotation means comprises:

said receiving socket having a noncircular cross sectional shape;

said extension having a cross sectional shape that is similar in shape and size to said receiving socket cross sectional shape and, thereby, prevents the relative rotation of said extension to said receiving socket.

13. A movable crane as claimed in claim 8 wherein said anti-rotation means comprises:

a plate attached to said extension;

a stationary plate receiver constructed to receive said plate and prevent motion of said plate in a direction tangent to an extension outer wall.

14. A movable crane as claimed in claim 8 wherein said anti-rotation means comprises:

an extension top end of said extension;

a support flange fixedly attached to said extension top end;

said support flange constructed to mate with and abut said socket top end and support radial and vertical loads associated with said movable crane;

at least one pin;

said support flange having a matching hole for each of said at least one pin;

said socket top end having a matching slot for each of said at least one pin;

each of said at least one pin sized to be inserted into said matching holes of said support flange and into said matching slots of said socket top end;

so that said at least one pin prevents the relative rotation of said extension to said receiving socket when said at least one pin is positioned within said holes and said slots.

15. A movable crane as claimed in claim 1 further comprising:

a socket cover constructed to mate with a socket top end; and thereby said receiving socket top end may be closed when said extension is removed from said receiving socket.

16. A movable crane as claimed in claim 1 further comprising a foundation support that provides support and anchor for said receiving socket.

17. A movable crane as claimed in claim 16 further comprising:

at least one socket anchor fixedly attached to said receiving socket; and said at least one socket anchor extending into said foundation support.

18. A movable kingpost crane system comprising:

a plurality of receiving sockets;

an upperworks, including a crane boom;

said upperworks including a platform;

said crane boom rotatably affixed at one end to said platform;

said crane boom including an end distal from said platform;

said crane boom distal end capable of being raised and lowered;

crane support means for supporting said upperworks;

said upperworks rotatable in relation to said crane support means;

said crane support means constructed to be selectively maintained and affixed in any of said plurality of receiving sockets;

said crane support means including an extension constructed to mate with each of said plurality of receiving sockets;

said crane support means removable from said sockets;

a socket detent extending axially upwards from a socket bottom end in each of said plurality of sockets;

said extension including an extension bottom;

said extension bottom including a detent receiver; and said socket detent and said detent receiver constructed and positioned for cooperative mating when said crane support means is positioned in each of said sockets.

19. A movable pedestal crane comprising:

an upperworks, including a crane boom;

said upperworks including a platform;

said crane boom rotatably affixed at an end to said platform;

said crane boom including an end distal from said platform;

said crane boom distal end capable of being raised and lowered;

crane support means for supporting said upperworks;

said upperworks rotatable in relation to said crane support means;

said crane support means constructed to be selectively maintained and affixed in a receiving socket;

said crane support means including an extension constructed to mate with said receiving socket;

said crane support means removable from said socket;

a socket detent extending axially upwards from a socket bottom end;

said extension including an extension bottom;

said extension bottom including a detent receiver; and said socket detent and said detent receiver constructed and positioned for cooperative mating when said crane support means is positioned in said socket.

* * * * *